United States Patent [19]

Butcher

[11] Patent Number: 4,825,222

[45] Date of Patent: Apr. 25, 1989

[54] OMNIDIRECTIONAL ANTENNA WITH HOLLOW POINT SOURCE FEED

[75] Inventor: Miles E. Butcher, Woodbridge, England

[73] Assignee: British Telecommunications PLC, London, England

[21] Appl. No.: 7,398

[22] Filed: Jan. 27, 1987

[30] Foreign Application Priority Data

Jan. 30, 1986 [GB] United Kingdom ..... 8602246

[51] Int. Cl.[4] ..... H01Q 19/17

[52] U.S. Cl. ..... 343/836; 343/781 P; 343/891

[58] Field of Search ..... 343/781 P, 781 CA, 781 R, 343/836, 890, 891, 837, 840

[56] References Cited

U.S. PATENT DOCUMENTS

| | | | |
|---|---|---|---|
| 2,486,589 | 11/1949 | Chu | 343/781 P |
| 3,781,897 | 12/1973 | Charlton | 343/836 |
| 3,887,926 | 6/1975 | Schwartz et al. | 343/816 |
| 4,014,027 | 3/1977 | Reinders | 343/781 P |
| 4,672,387 | 6/1987 | Waddoup et al. | 343/781 P |

FOREIGN PATENT DOCUMENTS

| | | |
|---|---|---|
| 1907696 | 9/1968 | Fed. Rep. of Germany . |
| 1801706 | 6/1970 | Fed. Rep. of Germany . |
| 1801707 | 9/1970 | Fed. Rep. of Germany . |
| 1392013 | 1/1964 | France . |
| 1126670 | 9/1970 | United Kingdom . |

*Primary Examiner*—William L. Sikes
*Assistant Examiner*—Doris J. Johnson
*Attorney, Agent, or Firm*—Nixon & Vanderhye

[57] ABSTRACT

An omnidirectional antenna comprises a ring-shaped subreflector surrounding an omnidirectional feed and a ring-shaped main reflector for redirecting radiation from the subsidiary reflector to the target zone. The feed has a focal ring and a hollow centre to accommodate supports, feeders etc which facilitates stacking of antennas.

15 Claims, 8 Drawing Sheets

Ideal azimuth footpint

Ideal elevation coverage angles

Ideal radiation pattern in x-z plane

Ideal radiation pattern in y-z plane

OMNIDIRECTIONAL ANTENNA WITH HOLLOW POINT SOURCE FEED

This invention relates to an omnidirectional antenna, e.g. an antenna which when suitably mounted on the surface of the earth is capable of transmitting to all points of the compass. More particularly, the invention concerns an antenna comprising an omnidirectional primary feed arranged in operation to radiate in directions generally transversely of an axis thereof, and a ring-shaped subsidiary reflector so positioned about the said axis as to reflect transmission radio signals onto the surface of a ring-shaped main reflector, the main reflector being positioned about the said axis and arranged to redirect the signals in directions generally transversely of the said axis.

The definition is given in terms of the transmit-mode. However the propagation of the radio waves is reversible so that the antenna is equally applicable to the receive-mode.

One application of omnidirectional antennas in telecommunications technology is concerned with point-to-multipoint radio systems in which a single station, usually called the node, communicates with many customers all within line-of-sight but scattered in random directions and distances around the node. Limiting the distance to line-of-sight limits the range to about 30 km but within that range the node should be able to communicate with a station anywhere. Thus the node requires an antenna which operates in all directios, i.e. an omnidirectional antenna.

An antenna of this type is described in UK Patent No. 1126670 (similar arrangements are also illustrated in German Offenlegungsschrift No. 1907696 and French Patent No. 1392013). A difficulty with the prior proposals however is that the feed is essentially a point source and antennas cannot be stacked one above the other owing to the inability to pass supports, cable or waveguide feeders etc up through the centre of the antenna.

In accordance with the invention it is provided that the feed and the subsidiary reflector have ring foci substantially coincident with one another, and that the feed in hollow.

Two or more antennas can readily be stacked since supports and/or feeders for the upper antenna(s) can readily be passed through the hollow centre of the primary feed(s) of the lower antennas (of course, if desired the uppermost antenna could be conventional).

Thus in another aspect the invention provides a stacked array of antennas comprising a first antenna and one or morefurther antennas as defined above.

In the preferred embodiments the reflectors are surfaces of revolution about the symmetry axis of the antenna. It is convenient to define a surface of revolution by means of the generator curve from which it is derived by revolution about the symmetry axis.

In the case of the subsidiary reflector the generator curve may conveniently be either an ellipse (i.e. an equivalent of the Gregorian configuration) or a hyperbola (i.e. an equivalent of the Cassegrain configuration). In both variants the second focus of the subsidiary reflector should be located outside the beam of the primary feed. It will be appreciated that a point focus gives rise to a ring-of-focus (at which, in the case of the Gregorian configuration, the energy is concentrated).

The subsidiary reflector and main reflector need not be derived from conic sections. In general, rays from any point on the subsidiary reflector may be reflected to any point on the main reflector. The art of reflector design is advanced to the point where any distribution of rays emerging from the main reflector, over an angular range of at least 90°, can be obtained by suitable shaping of one or both reflectors. In many cases it is convenient to retain the basic characteristics of the Gregorian and Cassegrain configurations, that is, in the first case the rays cross over, and in the second they do not.

A wide range of generator curves is available for the main reflector. These curves may, or may not, have an input point which gives rise to a ring-of-input which is located so as to be coincident with the ring-of-focus of the subsidiary reflector. Some examples of generator curves for the main reflector will now be given. In these examples it is convenient to assume that the symmetry axis of the antenna is vertical.

(a) Parabola

This generator gives a parallel main beam when fed from a focal ring. If the axis of the parabola is normal to the symmetry axis, i.e. horizontal, then the main beam is also horizontal. This would be excellent if all the outstation antennas were at the same height but it is usual for an omnidirectional antenna to be mounted high for communication to stations situated low and a horizontal beam would not meet such a requirement. The configuration would be improved by sloping the axis of the parabola downwards. This results in an antenna which gives a narrow annulus of strong signal on the ground. Thus the simple parabola is not usually the most effective generator for the main reflector.

(b) Distributive Curves

The problem of energy distribution has been recognised and designers have developed techniques for calculating the shapes of antennas to provide desired energy distributions. The antenna according to this invention is particularly intended to serve a plurality of outstations scattered at many ranges. It will be apparent that signals to a distant outstation suffer greater attenuation than signals to a near station. It is, therefore, desirable to provide more energy to the distant outstation in order to compensate for the attenuation. The design technique mentioned above can define a curve which will provide a prescribed energy distribution with distance. Such a curve is in practice the preferred generator curve for the main reflector of an antenna intended for use as the node. As was explained for parabolic main reflectors the axis of the generator curve is preferably inclined downwards at the desired target zone.

Some embodiments of the invention will now be described, by way of example, with reference to the accompanying drawings in which.

Figure 3:
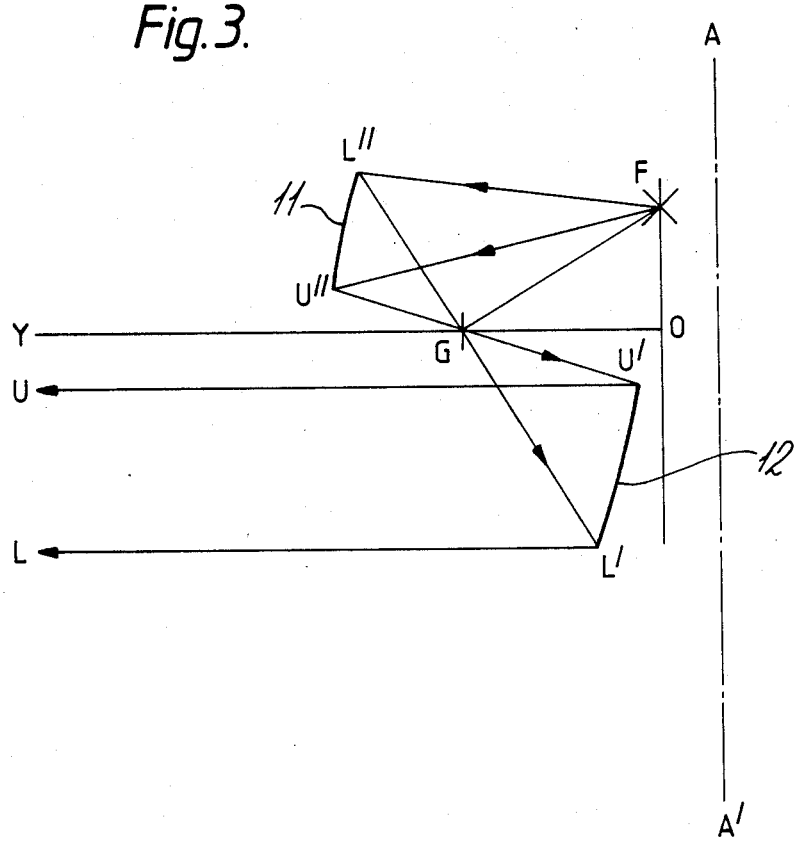
Figure 4:
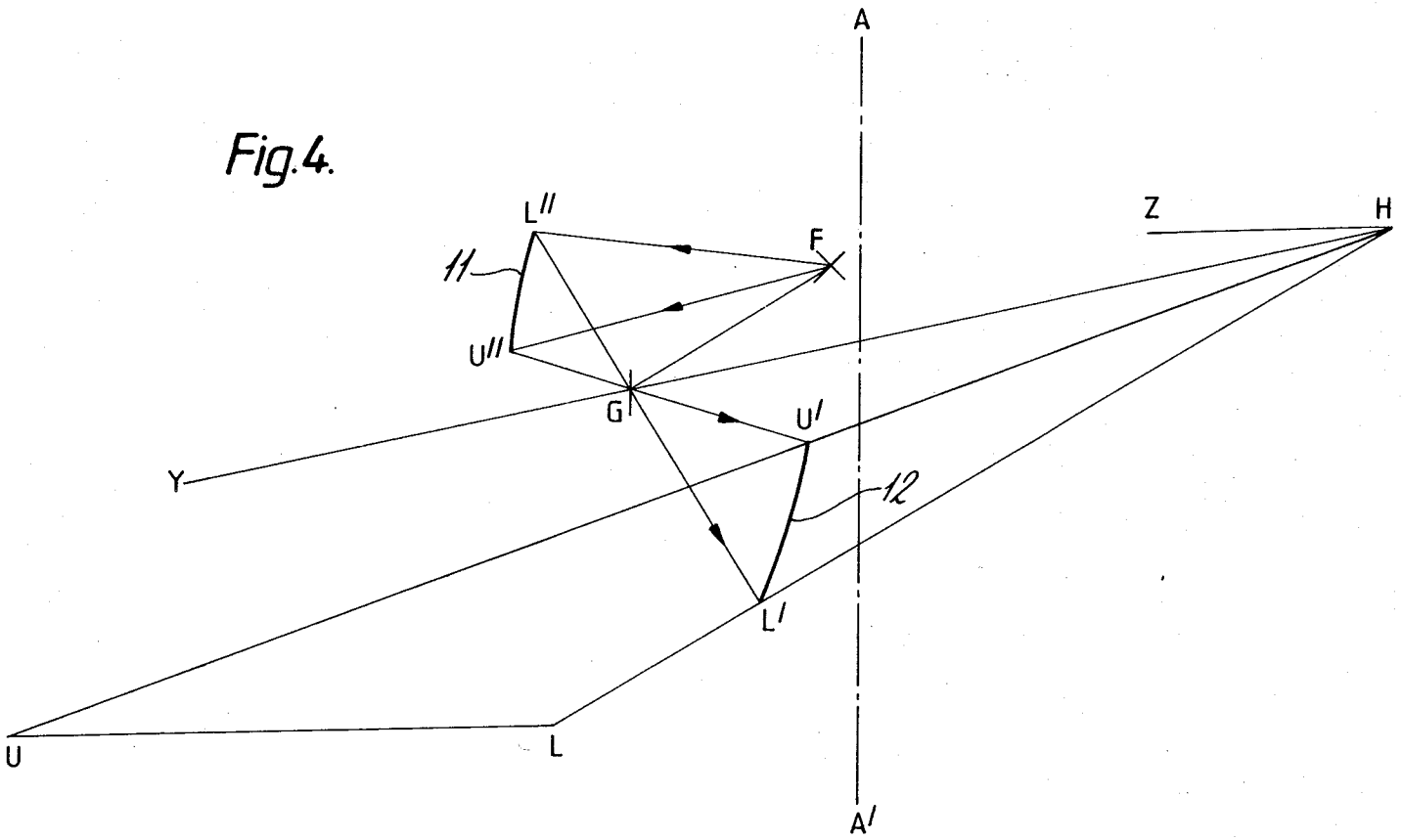
Figure 5:
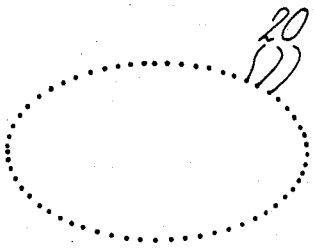
Figure 6:
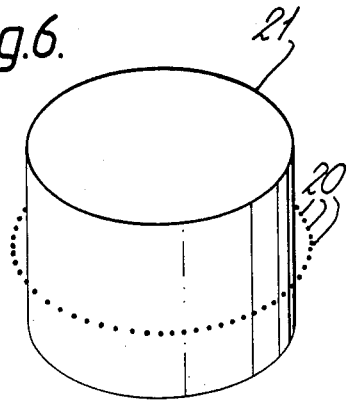
Figure 7:
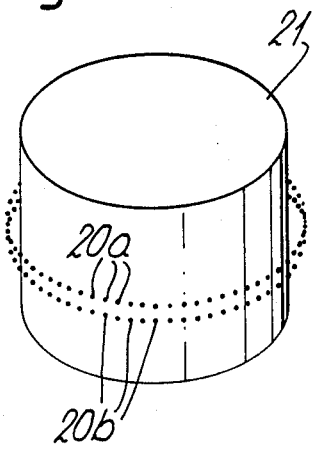
Figure 8:
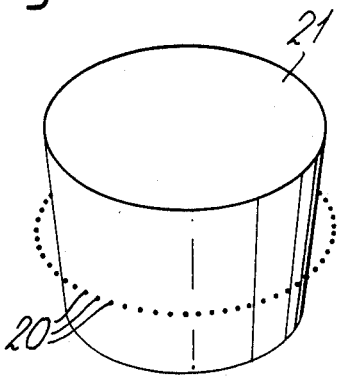
Figure 9:
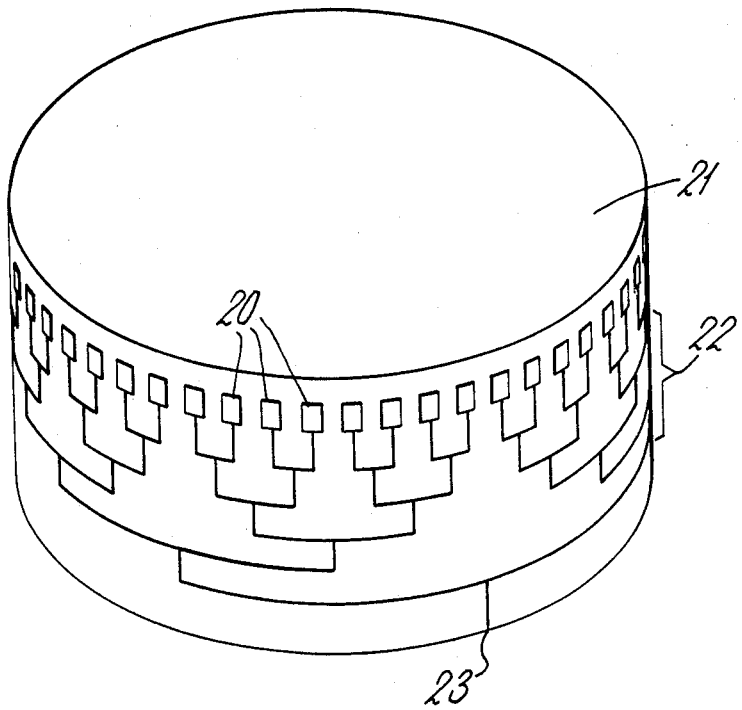
Figure 10:
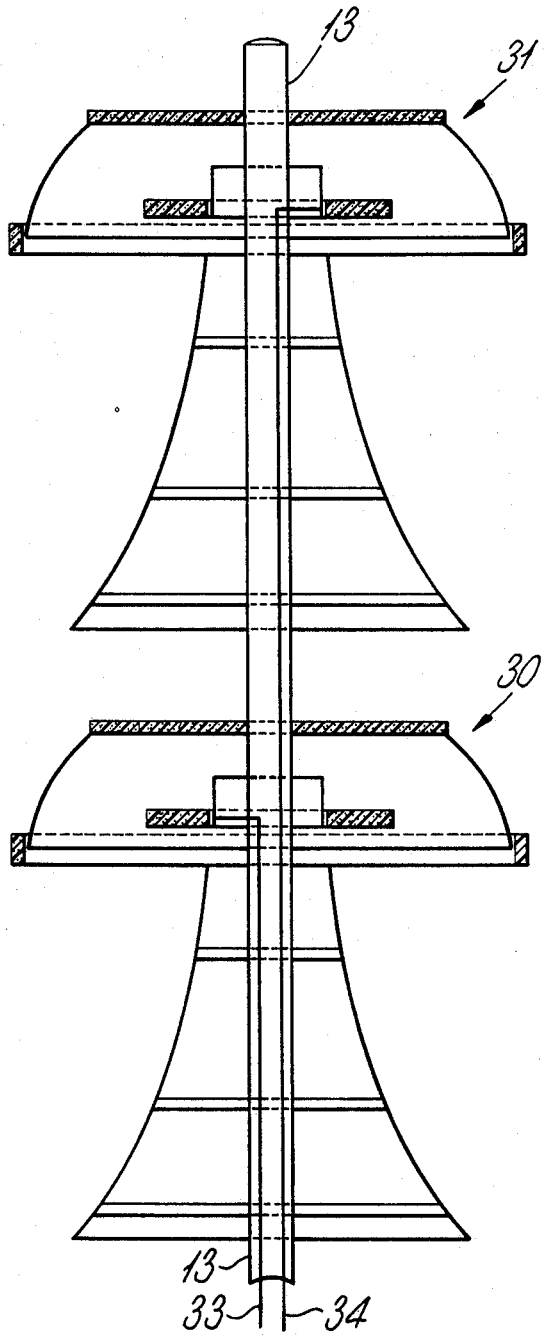

FIG. 3 the geometrical arrangement of the foci and axes for ellipsoidal and paraboloidal subsidiary and main reflectors;

FIG. 4 is a modified version of FIG. 3;

FIG. 5 illustrates schematically one form of an annular primary feed for the antenna;

FIGS. 6, 7 and 8 illustrate alternative annular primary feeds;

FIG. 9 is a perspective view of a practical annular primary feed;

FIG. 10 shows a stacked array of two antennas; and

Figure 11A:
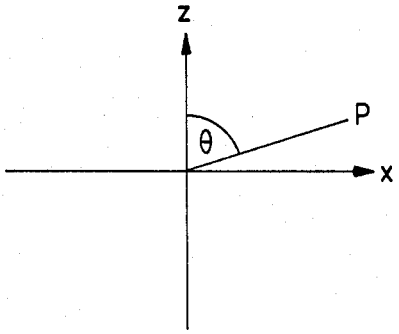
Figure 11B:
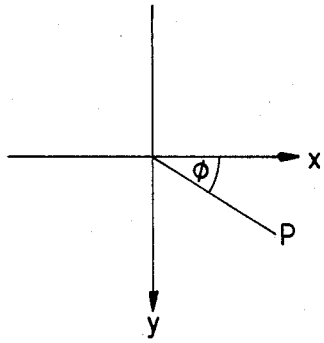
Figure 12A:
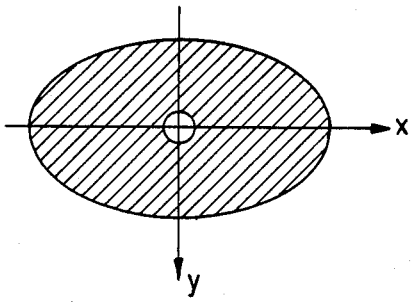
Figure 12B:
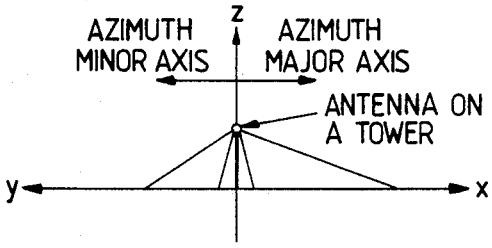
Figure 12C:
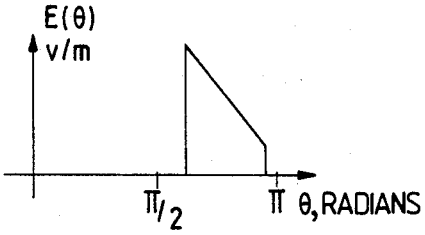
Figure 12D:
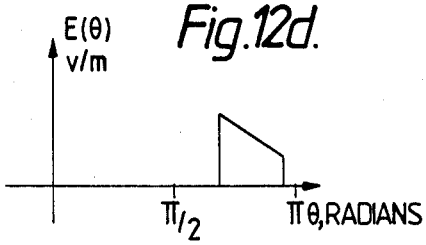

FIGS. 11(A), 11(B) and 12 are diagrams illustrating variations in radiation patterns of the antennas.

Figure 1:
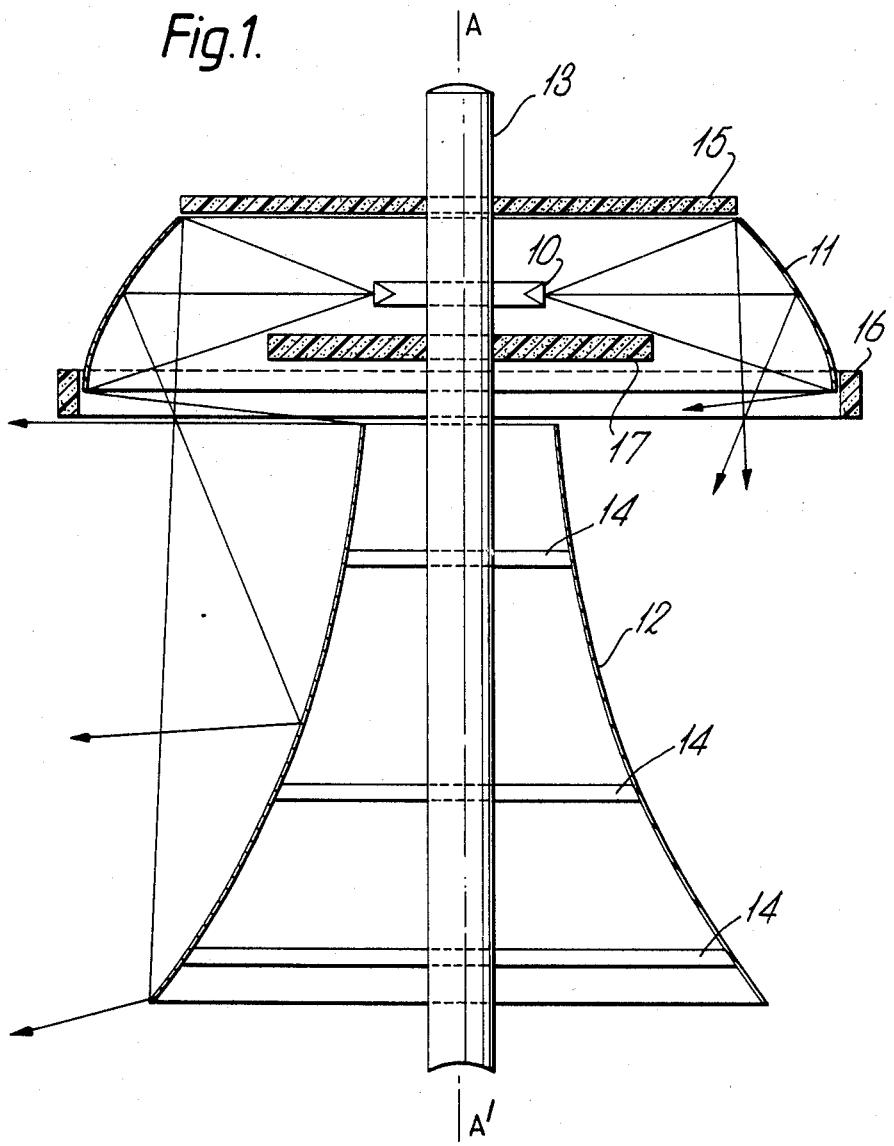
FIG. 1 illustrates a Gregorian antenna according to one embodiment of the inention.
Figure 2:
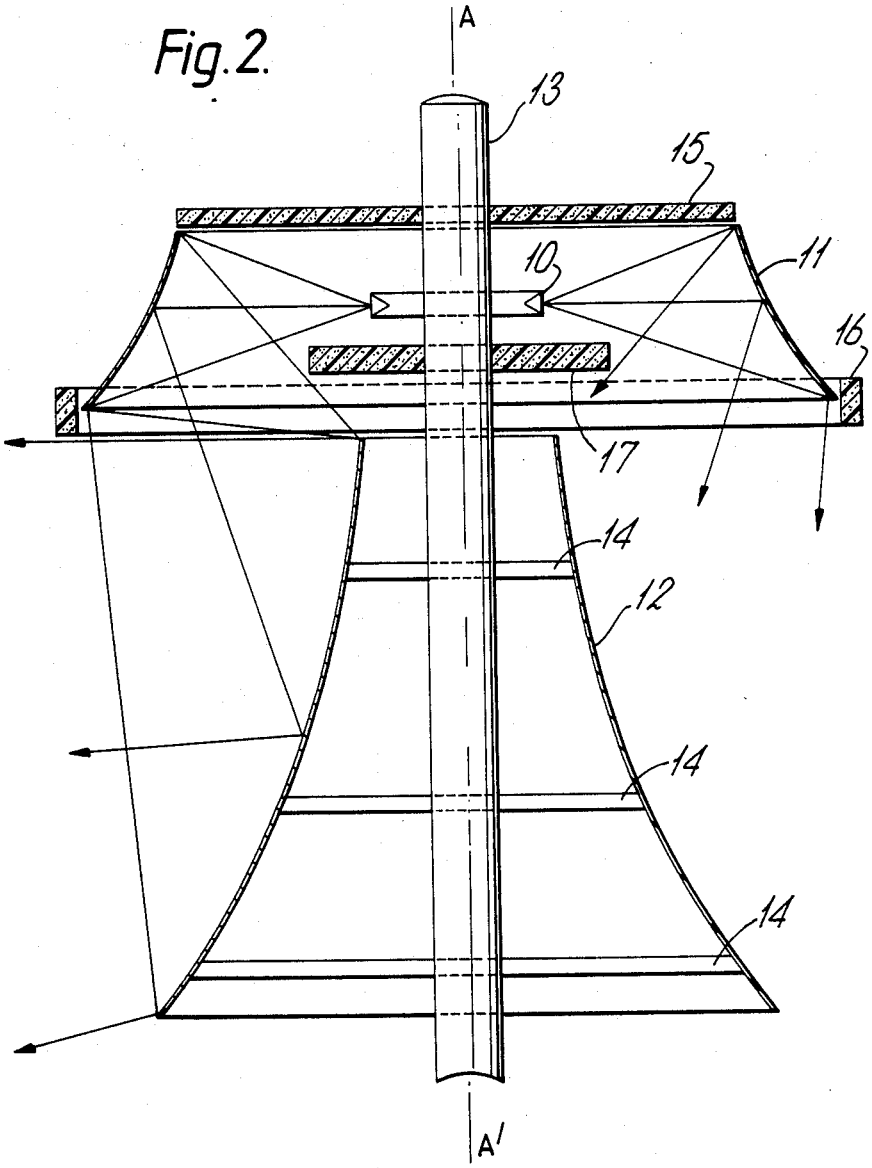
FIG. 2 illustrates a Cassegrain version of the antenna.

The antenna shown in FIGS. 1 and 2 each have an axis of symmetry shown as AA' (assumed to be aligned vertically). The antennas are shown as a vertical cross section containing AA'. Rotation about AA' gives, in each case, the complete antenna.

The antenna shown in FIG. 1 comprises a primary feed 10 which acts as a ring source having a focal circle centred on the axis AA'. The feed (the detailed construction of which is described below) has a hollow centre. The feed 10 is surrounded by a secondary reflector 11 which is elliptical in the plane of Figure 1. Rotation gives a ring which surrounds the feed 10; the first focal circle of the reflector 11 is coincident with that of the feed 10.

The secondary reflector 11 directs radiation onto the main reflector 12 which also has a ring structure. The secondary reflector 11 has a second focal circle which is coincident with the input ring of the main reflector 12. This arrangement leaves a hollow centre which contains a tubular support member 13 which supports mechanically the other components of the antenna. Thus it supports the main reflector 12 by a mechanically suitable arrangement of struts 14, whereas the feed 10 is directly mounted upon support member 13.

The support member also supports a top plate 15 made of absorbent (i.e. for radio waves) material such as carbon loaded foamed plastic. The secondary reflector 11 depends from the top plate 15 and an absorbent guard ring 16 depends from the lower rim of the secondary reflector 11. The antenna also includes a guard plate 17 of absorber supported on the support member 13 and located between horn 10 and the main reflector 12.

In the use of the antenna the absorbent elements, i.e. top plate 15, guard ring 16 and guard plate 17 reduce the radiation produced by the antenna in unwanted directions. For mounting a mast is desirable to engage with bore of support member 13. Waveguide or coaxial feeds pass up through the hollow mounting to the horn 10.

FIG. 2 shows the Cassegrain variant of FIG. 1. It comprises the same components which have the same reference numbers. The most important difference is that the secondary reflector 11 is generated from a hyperbola instead of an ellipse.

FIG. 3, which illustrates the basic geometry of a Gregorian version of the antennas, shows an elliptical secondary reflector 11, a parabolic main reflector 12 and the rotation axis AA'. The ellipse 11 has foci G and F with focus F offset from AA'. The parabolic main reflector 12 has its focus at G and its geometric axis OY is normal to the rotation axis AA'. FIG. 3 also traces an upper ray from the focus F, to subsidiary reflector 11 at U''. It reflects through focus G to the main reflector at U' and it emerges parallel to OY (YG) at U. Similarly a low ray follows the path FL''L'L. It will be appreciated that FIG. 2 corresponds to a conventional Gregorian system and it shows the inversion associated with this system; suitable rotation about OY would generate a conventional (pencil beam) Gregorian system. The antenna is generated by complete rotation about AA' whereby segments L''U'' and L'U' are converted into complete rings and foci F, G are converted into a circles.

The feed 10, not shown in FIG. 3, provides a uniform, omnidirectional beam which diverges from F at up to 10°, in this case, from the normal as indicated by the limiting rays FL'' and FU''. The focal circle of the feed is coincident with the first focal circle of the secondary reflector 11. This divergent beam is converted to an omnidirectional parallel beam by the antenna. This beam would be optimal for communicating with a plurality of outstations scattered around the antenna in random directions but at the same height. However it is more common to mount the central antenna high above the ground for communication with the outstations at ground level. In this case it is desirable to modify FIG. 3. A simple modification would be to incline axis YO at a (small) angle to the normal. If the antenna is at a height h and the angle of depression is D the antenna would give a maximum of intensity at range h cot D. However the concentrated beam would give a very narrow target zone. Further modification of FIG. 3 is needed to give a divergent beam.

FIG. 4, which has substantially the same labels as FIG. 3, shows a modification in which axis YG is inclined to the normal. The arc U'L' is modified to a hyperbolic arc having its second focus at H; ZH shows the horizontal. It will be apparent that the generators, i.e. arcs U''L'' and U'L', on rotation about AA' also give rise to an antenna having two ring shaped reflectors. The target zone takes the form of an annulus having the circle swept by U as the outer perimeter and the circle swept by L as the inner perimeter.

FIG. 4 illustrates the fact that suitable location of the critical points, i.e. the foci G and H, together with a suitable value for eccentricity would enable the beam to be matched to any annular target area. However the energy distribution given by conic sections tends to place more energy at L than at U. This is not appropriate when it is desired to compensate for attenuation by providing more energy towards U than towards L.

It is, however, emphasised that, while the shape of arc U'L' affects energy distribution, the omnidirectional features of the antenna are not affected by the shape of arc U'L'. The design techniques for calculating the shape needed to provide a desired distribution are already well established (and, as FIG. 4 illustrates, the calcuation is limited to two dimensions to produce a one-dimensional distribution). Rotation about the axis AA'' generates the required omnidirectional distribution.

FIGS. 3 and 4 relate to Gregorian forms and the focus G is below the feam from the horn. The Cassegrain forms, not illustrated, are very similar but the focus G would be above the beam from the horn and there would be no inversion.

As explained above, the ring-focus feed has a hollow centre. Although a biconical horn has a ring focus, it is characteristic of the horn that the coaxial feeder or waveguide is located on the axis of rotational symmetry and hence it is not possible to make use of the space inside the focal ring for mechanical support, either of the subreflector or of another antenna. To make this possible it is necessary to increase the diameter of the focal ring and to make the primary feed hollow.

One possible form of such a feed is constructed from a circular array of point sources 20 as shown in FIG. 5, each point source being energised with equal phase and amplitude, and the point sources would be equally spaced around the circle. It is desirable that each point source radiates only outwards, away from the axis of rotation. It is common practice in antenna design for point sources to be made unidirectional by placing them near a large electrically conducting surface, known as a ground plane, and in this instance it is convenient to form the ground plane into a cylinder 21 as shwon in FIG. 6. For this application the point sources may still have too broad a radiation pattern in the elevation direction to illuminate the subreflector efficiently, and to make the elevaton pattern narrower the point sources make the vertically arranged in groups of two or more using the well known techniques of array antenna design. The simplest case of two-element subarrays 1s shown in FIG. 7 with upper and lower elements 20*a*, 20*b*. It may be desirable in some versions of the antenna for the primary feed annular beam not to have its elevation pattern centred on a plane perpendicular to the rotaton axis: a hollow conical beam rather than a toroid may be needed. This may for instance be formed by either making the ground plane into a cone rather than a cylinder, as shown in FIG. 8, or by making the phase of the vertical subarray elements vary with their vertical position, using a well known phased array beam steering principle. Any reasonably small point source radiators may be used, for example dipoles, slots, notches, waveguides or half-wave patch antennas. At microwave frequencies patch antennas lend themselves conveniently to integrated fabrication with the power splitting network from which they are fed in the manner shown for example in FIG. 9. Here the power splitter network 22, point source array 20, and the ground plane 21 may be made in one photolithographic operation on flat flexible double-sided copper clad dielectric substrate which can be roller into a cylinder or cone. The power splitter is made from assymmetrical stripline and symmetrical T-junctions with identical power coupling and electrical line length from the input port 23 to each patch antenna.

FIG. 10 illustrates two omnidirectional antennas 30,31 mounted concentrically on the same mast one above the other, the pole 13 passing through their centres. It can be seen that the feed, subreflector and main reflector are clear of a cylindrical region in the centre of the antenna making room for such a pole. Feeders 34,34 are also shown.

It should also be noted that it is possible to employ a plurality of horns (each having its source on the primary focal curve of the sub-reflector). This increases the possibility of producing different properties in different directions. (The plurality of horns can be regarded as a composite primary feed.)

In some circumstances it may be desirable to vary the gain of the antenna with azimuth angle $\phi$and elevation angle $\theta$, where $\phi$is defined in FIG. 11(A) and $\theta$ is defined in FIG. 11(B). To take a simple example outstations served by the antenna may be located throughout an elliptically shaped city with the central station located in the centre, and in this case the further stations at the apexes would require more gain from the central station antenna to provide the same degree of communication system serviceability.

The surface of revolution is the easiest to manufacture but, it it is desired to vary energy distributions in different directions, other shapes may be used, for example an elliptical azimuth pattern may be made by forming the antenna into an elliptical ring rather than a circular ring. A simple conservation of energy argument shows that the higher gain directions coincide with minor axes of the antenna ellipse if the focal ring is uniformly energised along its length and the elevation pattern does not vary with azimuth angle. It is, of course, important that the curve generated by the primary focus of the sub-reflector coincide with the source-curve of the feed and that the curve generated by the secondary focus of the sub-reflector coincide with focal curve (or, if it has more than one focal curve, the primary focal curve) of the main reflector. Thus the invention can provide different properties in different directions (as well as substantially the same properties in all directions).

Generally the elevation pattern would vary with azimuth angle in the manner shown for instance in the example shown in the sketches of FIG. 12, and in this case focal lengths and/or shaping functions of the subreflector and main reflector may be continuously varied with the generating azimuth angle of the reflectors. The primary feed may be a circular ring source, an elliptical ring source, or, in principle, any other type of ring source. In FIG. 12 an elliptical coverage area is assumed, with a small circular uncovered area centred on the antenna defined perhaps by the parapet of the tower on which the antenna is mounted. Systems often require that the field strength produced by the antenna over the coverage area is constant, and consequently in that case the antenna must have more gain in the directions of the farthest points in the coverage area.

I claim:

1. An antenna comprising:

an omnidirectional primary feed means for radiating signals in directions substantially transversely of an axis, said feed means including a ring-shaped ground plane disposed about said axis;

a ring-shaped secondary reflector disposed about said axis, and a ring-shaped main reflector means positioned about the said axis, said secondary reflector so positioned relative to said main reflector means as to reflect radio signals onto the surface of said main reflector means, said main reflector means for redirecting said reflected signals in directions substantially transversely of the said axis, wherein the feed means and the secondary reflector have ring foci substantially coincident with one another, and the feed means is hollow and comprises a plurality of substantially point source radiator elements disposed about said ring-shaped ground plane.

2. An antenna according to claim 1 in which a power splitting network means for distributing energy to the radiator elements is formed on the ring-shaped ground plane.

3. An antenna according to claim 1 or 2 in which the focal rings of the primary feed means and the secondary reflector are circular.

4. An antenna according to claim 3, wherein the secondary reflector is defined by a surface of revolution.

5. An antenna according to claim 4, wherein the generator curve is a segment of one of an ellipse and a hyperbola.

6. An antenna according to claim 3, wherein the main reflector is defined by a surface of revolution.

7. An antenna as in claim 1 wherein all of said plurality of radiator elements are fed simultaneously.

8. An omnidirectional RF antenna comprising:

an annular conductive ground plane surface;

omnidirectional radiator means including plural radiator elements spaced from and disposed along a first annulus about said ground plane surface, said radiator means for radiating RF energy substantially omnidirectionally outwardly from said ground plane surface;

annular secondary reflector means disposed substantially concentrically with and about said first annulus and said ground plane surface for redirecting signals radiated by said radiator elements, said secondary reflector means redirecting said radiated signals in directions approximately coplanar with said ground plane surface; and annular primary reflector means for reflecting said redirected signals outwardly from said ground plane surface in a radiation pattern that is substantially omnidirectional in at least one plane.

9. An antenna as in claim 8 wherein said plural radiator elements are all connected to be fed simultaneously.

10. An antenna as in claim 8 further including means connected to said radiator means for driving all of said plural radiator elements simultaneously.

11. An antenna as in claim 10 wherein said ground plane surface defines a cylinder, and said radiator elements each comprise a microstrip half-wave patch spaced from said ground plane surface.

12. An antenna as in claim 10 wherein said radiator means comprises means for radiating RF energy in a narrow beam away from said ground plane surface.

13. An antenna as in claim 8 wherein said plural radiator elements are arranged such that most of the energy radiated by said radiator means is redirected by said secondary reflector means.

14. An antenna as in claim 8 wherein said primary reflector means is disposed concentrically with said first annulus.

15. An antenna as in claim 8 wherein said ground plane surface, said first annulus, said secondary reflector means and said primary reflector means are all circular and coaxial.

* * * * *